US009738097B2

(12) United States Patent
Nolting et al.

(10) Patent No.: US 9,738,097 B2
(45) Date of Patent: Aug. 22, 2017

(54) DEVICE FOR REDIRECTING SHEETS IN A PRINTING SYSTEM

(71) Applicant: Océ-Technologies B.V., Venlo (NL)

(72) Inventors: Erik E. M. Nolting, Venlo (NL); Joseph A. Schulkes, Venlo (NL); Marinus T. W. Gruntjens, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/937,684

(22) Filed: Nov. 10, 2015

(65) Prior Publication Data

US 2016/0129709 A1 May 12, 2016

(30) Foreign Application Priority Data

Nov. 12, 2014 (EP) ..... 14192806

(51) Int. Cl.
*B41J 13/00* (2006.01)
*B65H 29/58* (2006.01)
(Continued)

(52) U.S. Cl.
CPC ..... *B41J 13/0009* (2013.01); *B65H 5/26* (2013.01); *B65H 29/58* (2013.01); *B65H 29/62* (2013.01);
(Continued)

(58) Field of Classification Search
CPC ..... B41J 13/0009; B65H 29/62; B65H 5/26; B65H 29/58; B65H 2511/16;
(Continued)

(56) References Cited

U.S. PATENT DOCUMENTS 4,722,444 A 2/1988 Murphy et al.
6,325,371 B1 * 12/2001 Araki ..... B65H 29/60 270/58.22

FOREIGN PATENT DOCUMENTS

JP 5-58529 A 3/1993
JP 10-181977 A 7/1998
JP 2005-343620 A 12/2005

* cited by examiner

*Primary Examiner* — Henok Legesse
(74) *Attorney, Agent, or Firm* — Birch, Stewart, Kolasch & Birch, LLP

(57) ABSTRACT

A device for redirecting sheets in a sheet transport mechanism, especially sheets of a print medium in a printing system includes a support member, which carries or supports at least one guide member for directing a path of travel of a sheet. The support member is configured to be mounted adjacent a first transport path of a plurality of sheets and such that the support member is movable between a first inoperative position in which the at least one guide member does not impinge upon the first transport path, and a second operative position in which the at least one guide member is introduced into the first transport path to redirect one or more of the sheets to a second, alternative transport path. The device further includes an actuator configured to move the support member between the first and second positions. The actuator is connected to the support member such that vibrations imparted by the actuator to the support member, as the support member moves between the first and the second positions, are substantially parallel to the first transport path.

18 Claims, 6 Drawing Sheets

(51) Int. Cl.
*B65H 29/62* (2006.01)
*B65H 5/26* (2006.01)

(52) U.S. Cl.
CPC .... *B65H 2404/632* (2013.01); *B65H 2511/16* (2013.01); *B65H 2515/842* (2013.01); *B65H 2555/13* (2013.01); *B65H 2601/524* (2013.01); *B65H 2801/06* (2013.01); *B65H 2801/15* (2013.01)

(58) Field of Classification Search
CPC ..... B65H 2801/15; B65H 2801/06; B65H 2515/842; B65H 2555/13; B65H 2404/632; B65H 2601/524
See application file for complete search history.

DEVICE FOR REDIRECTING SHEETS IN A PRINTING SYSTEM

CROSS-REFERENCE TO RELATED APPLICATIONS

This application claims priority under 35 U.S.C. §119(a) to application Ser. No. 14/192,806.9 filed in Europe on Nov. 12, 2014, the entire contents of which is hereby incorporated by reference into the present application.

BACKGROUND OF THE PRESENT INVENTION

1. Field of the Invention

The present invention relates to a device for redirecting sheets in a sheet transport mechanism, and especially sheets of a print medium in a printing system, such as an inkjet printing system. Further, the present invention relates to a sheet transport mechanism and to a printing system that includes such a device to improve and/or optimize productivity of the system.

2. Description of Background Art

Deformations present within a sheet of a print medium in a printing system can be problematic for various reasons. Firstly, one or more such deformations can cause serious reliability problems in a printing system, such as an inkjet printing system, where there is only a small gap between a sheet transport mechanism and an image forming device or printing head of the printing system. If the sheet to be printed touches the image forming device or the printing head as a result of such a deformation, this can lead to print quality degradation and/or to a sheet jam in the machine. To achieve high print quality in an inkjet printing system, the distance between the printing heads and sheet to be printed should be kept small. Because of this small distance (print gap) the print heads are easily touched by the sheets as they pass. Accordingly, even small defects like dog ears, wrinkles, tears, etc. can cause a so-called "head touch", which can degrade print quality, cause nozzle failure, or even sheet jams. Secondly, if the sheets of a printed medium output from the printing system include any such deformations, this naturally compromises the quality of the output. Depending on the degree or extent of the deformations in the printed sheets, therefore, those sheets may need to be discarded and re-printed.

To address these issues, systems have been developed, which employ a proofing device capable of identifying sheet deformations and rejecting sheets that contain such deformations. Rejecting one or more sheets, which have been identified as having unacceptable defects or deformations, then involves removing these sheets from a transport path through the printing system. This task may, for example, be performed by a device for redirecting the defective sheets to an alternative path, e.g. to a discharge path. Some conventional redirection devices have been found to exhibit reliability problems, however, in printing applications where the sheets have a relatively high feed rate, e.g. of over 200 sheets per minute. In this regard, conventional devices have been found to experience sheet jams, even when the sheets themselves have not appeared to be sufficiently defective or deformed to cause such a jam, an issue which has confused and confounded designers.

U.S. Pat. No. 6,325,371 B describes a conveying path changing device, having a plurality of branched paths branched from a main conveying path, and a plurality of oscillatable flappers for selecting between a changed position where the sheet is guided from the main conveying path to one of the branched paths and a retracted position permitting passage of the sheet. A single solenoid oscillates the plurality of flappers, while a sensor confirms movements of the flapper by detecting a movement of the link. Before the flappers strike against abutment stoppers, the actuating speeds of the flappers and the links are decreased to suppress the impact noise.

SUMMARY OF THE INVENTION

In view of the above, an object of the present invention is to provide an improved device for redirecting sheets in a sheet transport mechanism, especially sheets of a print medium in a printing system, such as an inkjet printer. It is also an object to provide a transport mechanism and a printing system or printing machine including such a sheet redirection device.

In accordance with the present invention, a device for redirecting sheets, especially sheets of a print medium, having the features as recited in the independent claims is provided. Preferred and/or advantageous features of the present invention are recited in the dependent claims.

According to one aspect, therefore, the present invention provides a device for redirecting sheets in a sheet transport mechanism, and especially sheets of a print medium in a printing system, the device comprising:

a support member carrying at least one guide member for directing a path of travel of a sheet, wherein the support member is configured to be mounted adjacent a first transport path of a plurality of sheets such that the support member is movable between a first inoperative position in which the at least one guide member does not impinge upon the first transport path, and a second operative position in which the at least one guide member is introduced or inserted into the first transport path to redirect one or more of the sheets to a second, alternative transport path; and an actuator configured to move the support member between the first and second positions, wherein the actuator is connected to the support member such that vibrations imparted by the actuator to the support member as the support member is moved between the first and the second positions are substantially parallel to the first transport path.

In this way, the inventors have been able to address the problem of sheet jams caused by conventional sheet redirection devices. In particular, the inventors have been able to ascertain that some conventional sheet redirection devices operating in high feed-rate sheet transport mechanisms are subject to vibrations that cause the guide member(s) to impinge upon or enter the first transport path at a time or moment when the support member should be in the first inoperative position. As a result, the guide member(s) in the conventional sheet redirection devices can interact with and/or block the sheets on the first transport path when the sheets should actually be allowed to travel on the first transport path without impediment. Furthermore, the inventors have also determined that the problematic vibration of the support member is generated or imparted by the actuator. While it is naturally not possible to eliminate all vibration from such sheet redirection devices, especially in a high feed-rate sheet transport mechanism in which the support member carrying the guide member(s) must be capable of switching between the first and second positions at a high frequency, the inventors have developed a new and improved configuration for the device in which the vibrations imparted by the actuator to the support member are oriented so as to substantially eliminate a phenomenon of unwanted guide member impingement on the first transport path. In particular, the inventors have developed a configuration for the device in which the vibrations are substantially parallel to the first transport path. In the context of this disclosure, the term "substantially parallel" will be understood as meaning that the vibrations are predominantly within a plane or planes which extend(s) at an angle in the range of about −20° to about +20° to a plane of the sheets in the first transport path.

In a particularly preferred embodiment, the device comprises a plurality of guide members provided on the support member for directing a path of travel of a sheet. The guide members are preferably arranged spaced apart from one another (e.g. evenly or uniformly spaced apart) along the support member. Each of the plurality of guide members is typically provided with substantially the same orientation and configuration.

In a preferred embodiment of the present invention, the support member is configured for rotation between the first position and the second position. To this end, the support member is typically elongate, preferably in the form of a shaft, and is mounted for rotation about its longitudinal axis. The support member may be configured to extend transversely of or across the first transport path, and each guide member preferably extends from the support member in a direction generally perpendicular to a longitudinal axis of the support member. In this regard, each guide member is preferably elongate and may comprise a prong or needle element presenting a guide surface for directing the path of travel of a sheet. This prong- or needle-like configuration provides each guide member with a relatively low mass, which is desirable for achieving high-speed movement into and out of the first transport path as the support member is moved or switched between the first and second positions. In the second position, each guide member preferably extends inclined at an acute angle to the first transport path of the sheet, whereby the acute angle is preferably in the range of 10° to 60°, more preferably in the range of 20° to 40°. Furthermore, in this second position, at least a tip region or a distal end region of each guide member extends into or is introduced into the first transport path of the sheets. In the first position, on the other hand, each guide member may extend substantially parallel to the first transport path of the sheets. The guide members are preferably formed or configured to be relatively stiff or rigid and, to this end, are preferably comprised of a material with a relatively high modulus of elasticity, such as a steel.

In a preferred embodiment, the actuator includes a linear actuator, such as a solenoid or linear motor, connected to the support member for generating a drive action in a direction substantially parallel to the first transport path. In this way, the input force from the linear actuator (e.g. solenoid) to the elongate support member acts substantially parallel to the first transport path. As an alternative, however, the actuator may comprise a rotary actuator. Whether a linear actuator or a rotary actuator is employed, the actuator may operate in conjunction with a spring, e.g. provided as a return spring, when the actuator is de-energized or switched off. Alternatively, and/or in addition, the actuator may be operable in both directions to actively move the support member both to the first position and to the second position.

According to a preferred embodiment, a device for redirecting sheets in a sheet transport mechanism is provided, comprising:

a support member comprising one or more guide members for directing a path of travel of a sheet, wherein the support member is configured to be mounted adjacent a first transport path of a plurality of sheets such that the support member is movable between a first inoperative position in which the one or more guide members do not impinge upon the first transport path, and a second operative position in which the one or more guide members are introduced or inserted into the first transport path to redirect the sheets to a second transport path; and an actuator configured to move the support member between the first and second positions, wherein the actuator comprises a linear actuator which is connected to the support member for imparting an actuating force to the support member in a direction substantially parallel to the first transport path.

In a preferred embodiment, the actuator includes a lever arm connected to the support member for transmitting a force to move the support member between the first and second positions, especially for interconnecting the linear actuator with the support member. As the linear actuator is arranged for applying an input force to the elongate support member, which acts in a plane substantially parallel to the first transport path, the lever arm is preferably arranged to extend generally perpendicular to the first transport path, for example, approximately vertically. The lever arm is preferably substantially stiff or rigid and is desirably rigidly connected with the support member for optimizing a transfer of the drive action or actuating force from the linear actuator to the support member.

In a preferred embodiment, the actuator includes a first stop member, which defines the first inoperative position of the support member. Further, the actuator includes a contact member provided on the support member to engage the first stop member when the support member moves to the first position from the second position. Desirably, the contact member extends generally perpendicular to the first transport path when the support member is in the first position; for example, approximately vertically. The actuator may include a second stop member, which defines the second position. Thus, the contact member provided on the support member may be configured to engage the second stop member when the support member moves to the second position from the first position. For the sake of adjusting or calibrating the sheet redirection device, a position of either or both of the first and second stop members is preferably adjustable.

In a preferred embodiment, a controller is configured to control operation of the actuator to move or switch the support member between the first and second positions, depending on a detected state of the sheets travelling along the first transport path. For example, the controller may control further progress of the sheets on the first transport path of the sheet transport mechanism, especially in a printing system, depending upon deformations in the surface geometry or topology of the sheet detected by a defect detector apparatus. The controller is configured to control and/or to operate the sheet redirection device of the invention, which may act as a removal device for removing the sheet from the first transport path of the printing system if and when the defect detector apparatus identifies one or more deformations in the surface geometry or topology of the sheet that renders the sheet unsuitable for printing. In this way, the present invention is configured to prevent the printing system from being stopped or negatively impacted by a defective sheet of print medium. When a sheet deformation or defect is found, the sheet can be removed from the first transport path via the sheet redirection device, which may switch or redirect the defective sheet to a second transport path which conveys that sheet to a reject tray.

In a particularly preferred embodiment, the sheet to be printed is a sheet of a print medium selected from the group comprised of: paper, polymer film, such as polyethylene (PE) film, polypropylene (PP) film, polyethylene terephthalate (PET) film, metallic foil, or a combination of two or more thereof. Paper is especially preferred as the print medium and each sheet of paper typically has a density in the range of 50 g to 350 g per square meter.

According to another aspect, the present invention provides a transport mechanism for transporting a plurality of sheets, and especially sheets to be printed in a printing system, the transport mechanism comprising a device for redirecting one or more sheets according to any one of the embodiments described above. The sheet redirection device may be employed in any one or more of a number of different applications, including in a sheet removal device for redirecting defective sheets to a reject tray on a second transport path, as noted above.

According to a further aspect, the present invention also provides a printing system for printing sheets of a print medium, the system comprising a device for redirecting one or more sheets according to any one of the embodiments described above.

In a preferred embodiment, the printing system includes an apparatus for detecting a defect in a sheet of print medium, comprising:

a sensing unit including at least one first sensor device for sensing a surface geometry or topology of a sheet to be printed as the sheet travels on a transport path of the printing system and for generating data that is representative of that surface geometry or topology; and a processor device for processing the data from the first sensor device to detect and classify deformations in the surface geometry or topology of the sheet.

Thus, the printing system includes an apparatus or device for sheet deformation measurement, which is capable of sensing and measuring the surface shape of the sheet. By analyzing the surface shape data of the sheet, relevant deformations or defects in the sheet and their properties can be detected or identified or extracted from the data. Furthermore, a classification can be made for each deformation or defect found within the sheet; for example, a type or shape classification (e.g. a "dog ear", curl, or waviness) and/or a size classification can be made. The data from the detection and classification of the deformations may then be used to assess or determine the suitability of the sheet for printing, to find a root cause or root defect in the printing system and/or to monitor printing system performance.

In a preferred embodiment of the present invention, the processor device is configured to detect and classify deformations in the surface geometry or topology of the sheet to determine whether a deformation renders the sheet unsuitable for printing, for example, because a detected deformation exceeds a threshold size or extent. In the event that the sheets have a defect, such as a curl, waviness or a dog-ear, these sheets increase the risk of a sheet jam, damage to the image forming unit or printing head, defects in the printed image, and so on.

In a preferred embodiment, therefore, the apparatus includes a controller, which controls further progress of the sheet on the transport path of the printing system, depending upon the deformations in the surface geometry or topology of the sheet detected by the processor. The controller is configured to control and/or to operate a removal device, especially a sheet redirection device, for removing the sheet from the transport path of the printing system if and when the processor device identifies one or more deformations in the surface geometry or topology of the sheet that renders the sheet unsuitable for printing. In this way, the present invention is able to prevent the printing system from being stopped or negatively impacted by a defective print medium sheet. When a sheet deformation or defect is found, the sheet can be removed from the transport path via the sheet redirection device, which is able to switch or redirect the defective sheet to a reject tray path. Such a removal device or ejector device operated by the controller is preferably part of the printing system. Depending on the result of sheet form sensing, therefore, every sheet may be assessed or analyzed according to the at least one predetermined criterion (i.e. as a removal or ejection criterion) as to whether the sheet should be removed or ejected from the transport path. To prevent the printing system from experiencing a loss of print quality, or a nozzle failure or a sheet jam, the controller may thus operate to prevent a sheet in which one or more deformations or defects are detected from progressing to an image forming device or printing head unit of the system. But if the apparatus determines a sheet to be free of deformations or defects or to have only tolerable deformations or defects, it is allowed to progress to the image forming unit.

Preferably, it may be a further object of the present invention to provide an improved device for reliably redirecting sheets in a sheet transport mechanism at relatively high feed rates, especially sheets of a print medium in a printing system, such as an inkjet printer. It is also an object to provide a transport mechanism and a printing system or printing machine including such a sheet redirection device.

In accordance with the present invention, a device for redirecting sheets, especially sheets of a print medium, having the features recited in the independent claims is provided. Preferred and/or advantageous features of the present invention are recited in the dependent claims.

It is the insight of the inventors that vibrations of the guide members can be reduced by redirecting the vibrational energy from the impact related to the actuation of the guide members away from the guide members, thereby keeping the transport path unobstructed in a first position of the guide members.

According to one aspect, therefore, the present invention provides a device for redirecting sheets in a sheet transport mechanism, and especially sheets of a print medium in a printing system, the device comprising:

a support member carrying at least one guide member for directing a path of travel of a sheet, the support member being configured to be mounted adjacent a first transport path of a plurality of sheets such that the support member is movable between a first inoperative position in which the at least one guide member does not impinge upon the first transport path, and a second operative position in which the at least one guide member is introduced or inserted into the first transport path to redirect one or more of the sheets to a second, alternative transport path; and an actuator configured to move the support member between the first and second positions, wherein a first stop member defines the first position, a second stop member defines the second position, and a contact member engages the first stop member when the support member moves to the first position from the second position, and the contact member engages the second stop member when the support member moves to the second position from the first position, and wherein the first stop member and the second stop member are mounted on a frame by a resilient suspension.

In this way, the inventors have been able to address the problem of sheet jams caused by conventional sheet redirection devices. In particular, the inventors have been able to ascertain that some conventional sheet redirection devices operating in high feed-rate sheet transport mechanisms are subject to vibrations that cause the guide member(s) to impinge upon or enter the first transport path at a time or moment when the support member should be in the first inoperative position. As a result, the guide member(s) in the conventional sheet redirection devices can interact with and/or block the sheets on the first transport path when the sheets should actually be allowed to travel on the first transport path without impediment. Furthermore, the inventors have also determined that the problematic vibration of the support member is generated or imparted by the actuator. While it is naturally not possible to eliminate all vibration from such sheet redirection devices, especially in a high feed-rate sheet transport mechanism in which the support member carrying the guide member(s) must be capable of switching between the first and second positions at a high frequency, the inventors have developed a new and improved configuration for the device in which the vibrations imparted by the actuator to the support member are oriented so as to substantially eliminate a phenomenon of unwanted guide member impingement on the first transport path. In particular, the inventors have developed a configuration for the device in which the vibrations are substantially reduced. The impact of the contact member against a stop member is transferred into the resilient suspension, which, for example, then starts to vibrate instead of the guide members. Basically, the vibrational energy is directed and/or absorbed in the resilient suspension instead of being transmitted to the guide members. Thus, the vibrations are directed away from the guide members, keeping the guide members substantially parallel to the transport path in the first position. This allows for rapid and reliable switching without the risk of obstructing the transport path. Thus, the object of the present invention has been achieved.

In the context of this disclosure, the term "substantially parallel" will be understood as meaning that the vibrations are predominantly within a plane or planes, which extend(s) at an angle in the range of about −20° to about +20° to a plane of the sheets in the first transport path.

In a preferred embodiment, the contact member is provided on the support member. Preferably, the contact member is rigidly connected to the support member for accurate control of the actuation motion of the support member. The rigid connection between the contact member and the support member ensures that the motion of the support member is halted directly when the contact member engages a stop member. To this end, the contact member may further be relatively rigid or stiff compared to the support member to avoid deformation of the contact member.

In an embodiment, the bending stiffness of the contact member is selected to be high compared to a bending stiffness of the resilient suspension and/or a bending stiffness of the frame. The resilient suspension and/or the frame is then able to absorb vibrational energy, such that vibrations originating from the impact between contact member and stop member are directed to the resilient suspension and/or frame, and as such away from the guide members. Additionally, bouncing of the contact member is reduced, since the suspension and/or frame is able to absorb a significant amount of the energy of the impact between stop member and contact member. Due to its relative low stiffness, the resilient suspension is more prone to absorb the impact due to the contact member and start vibrating than, e.g. a guide member. The less stiff resilient suspension may be arranged to act as a spring-like suspension, absorbing the vibrations, which would otherwise have been transmitted to the guide member to improve the reliability of the device.

In a further embodiment, the resilient suspension comprises a spring element connecting the first and second stop members to the frame. The spring element can be a spring, leaf spring, or dampening element. Preferably, the frame comprises a cut-out region around the stop members for forming the resilient suspension. For example, a C-section is cut-out around the stop members for forming the resilient suspension, such that these are positioned on a lever connected at one end to the frame. The lever is able to vibrate with respect to the frame for absorbing vibrational energy from the impact between the contact member and stop member. As such, a majority of the vibrations is prevented from reaching the guide members.

In another embodiment, the support member is configured for rotation between the first position and the second position. The actuator includes a linear actuator connected to the support member for generating a drive action in a direction substantially parallel to the first transport path. The actuator is connected to the support member, such that vibrations imparted by the actuator to the support member, as the support member moves between the first and the second positions, are substantially parallel to the first transport path. By directing the vibrations parallel to the transport path, the chance of unintentional obstruction of the transport path by a guide member is reduced, since the guide member vibrates substantially parallel to the plane of the transport path instead of perpendicular thereto. Thus, even when a guide member absorbs vibrational energy, it will not unintentionally obstruct a sheet on the transport path, as the guide member moves substantially parallel to the sheet's travel direction.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
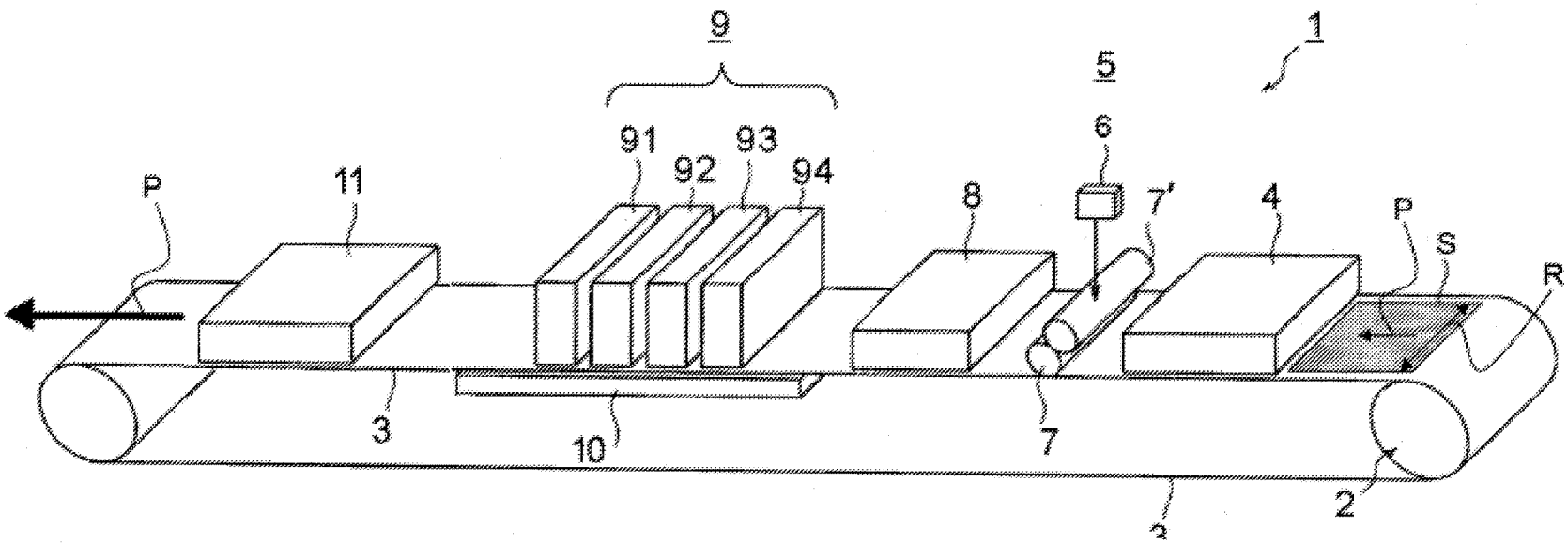
FIG. 1 is a schematic side view of part of a printing system according to an embodiment of the present invention.

The present invention will now be described with reference to the accompanying drawings, wherein the same reference numerals have been used to identify the same or similar elements throughout the several views.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

With reference to FIG. 1 of the drawings, a portion of an inkjet printing system 1 according to a preferred embodiment of the present invention is shown. FIG. 1 illustrates in particular the following parts or steps of the printing process in the inkjet printing system 1: media pre-treatment, image formation, drying and fixing and optionally post treatment. Each of these will be discussed briefly below.

FIG. 1 shows that a sheet S of a receiving medium or print medium, in particular a machine-coated print medium, is transported or conveyed along a transport path P of the system 1 with the aid of transport mechanism 2 in a direction indicated by arrows P. The transport mechanism 2 according to this embodiment may comprise a driven belt system having one or more endless belts 3. Alternatively, the belt(s) 3 may be exchanged for one or more drums 3. The transport mechanism 2 may be suitably configured depending on the requirements of the sheet transport in each step of the printing process (e.g. sheet registration accuracy) and may hence comprise multiple driven belts and/or multiple drums 3, 3'. For proper conveyance of the sheets S of the receiving medium or print medium, the sheets S should be fixed to or held by the transport mechanism 2. The manner of such fixation is not limited but typically includes vacuum fixation (e.g. via suction or under-pressure) although electrostatic fixation and/or mechanical fixation (e.g. clamping) may also be employed.

Media Pre-Treatment

To improve spreading and pinning (i.e. fixation of pigments and water-dispersed polymer particles) of the ink on the print medium, in particular on slow absorbing media, such as machine-coated media, the print medium may be pre-treated, i.e. treated prior to the printing of an image on the medium. The pre-treatment step may comprise one or more of the following:

i. pre-heating of the print medium to enhance spreading of the ink used on the print medium and/or to enhance absorption into the print medium of the ink used;

ii. primer pre-treatment for increasing the surface tension of the print medium in order to improve the wettability of the print medium by the ink used and to control the stability of the dispersed solid fraction of the ink composition, i.e. pigments and dispersed polymer particles; (N.B. primer pre-treatment can be performed in a gas phase, e.g. with gaseous acids such as hydrochloric acid, sulphuric acid, acetic acid, phosphoric acid and lactic acid, or in a liquid phase by coating the print medium with a pre-treatment liquid. A pre-treatment liquid may include water as a solvent, one or more co-solvents, additives such as surfactants, and at least one compound selected from a polyvalent metal salt, an acid and a cationic resin); and iii. corona or plasma treatment.

FIG. 1 illustrates that the sheet S of the print medium may be conveyed to and passed through a first pre-treatment module 4, which module may comprise a preheater, (e.g. a radiation heater), a corona/plasma treatment unit, a gaseous acid treatment unit or a combination of any of these. Subsequently, a predetermined quantity of the pre-treatment liquid may optionally be applied on a surface of the print medium via a pre-treatment liquid applying device 5. Specifically, the pre-treatment liquid is provided from a storage tank 6 to the pre-treatment liquid applying device 5, which comprises double rollers 7, 7'. A surface of the double rollers 7, 7' may be covered with a porous material, such as sponge. After providing the pre-treatment liquid to auxiliary roller 7' first, the pre-treatment liquid is transferred to main roller 7, and a predetermined quantity is applied onto the surface of the print medium. Thereafter, the coated printing medium (e.g. paper) onto which the pre-treatment liquid was applied may optionally be heated and dried by a dryer device 8, which comprises a dryer heater installed at a position downstream of the pre-treatment liquid applying device 5 in order to reduce the quantity of water content in the pre-treatment liquid to a predetermined range. It is preferable to decrease the water content in an amount of 1.0 weight % to 30 weight % based on the total water content in the pre-treatment liquid provided on the print medium sheet S. To prevent the transport mechanism 2 from being contaminated with pre-treatment liquid, a cleaning unit (not shown) may be installed and/or the transport mechanism 2 may include a plurality of belts or drums 3, 3', as noted above. The latter measure avoids or prevents contamination of other parts of the printing system 1, particularly of the transport mechanism 2 in the printing region.

It will be appreciated that any conventionally known methods can be used to apply the pre-treatment liquid. Specific examples of an application technique include: roller coating (as shown), ink-jet application, curtain coating and spray coating. There is no specific restriction in the number of times the pre-treatment liquid may be applied. It may be applied just one time, or it may be applied two times or more. An application twice or more may be preferable, as cockling of the coated print medium can be prevented and the film formed by the surface pre-treatment liquid will produce a uniform dry surface with no wrinkles after application of the pre-treatment liquid two or more times. A coating device 5 that employs one or more rollers 7, 7' is desirable because this technique does not need to take ejection properties into consideration and it can apply the pre-treatment liquid homogeneously to a print medium. In addition, the amount of the pre-treatment liquid applied with a roller or with other devices can be suitably adjusted by controlling one or more of: the physical properties of the pre-treatment liquid, the contact pressure of the roller, and the rotational speed of the roller in the coating device. An application area of the pre-treatment liquid may be only that portion of the sheet S to be printed, or an entire surface of a print portion and/or a non-print portion. However, when the pre-treatment liquid is applied only to a print portion, unevenness may occur between the application area and a non-application area caused by swelling of cellulose contained in coated printing paper with water from the pre-treatment liquid followed by drying. From a view-point of uniform drying, it is thus preferable to apply the pre-treatment liquid to the entire surface of a coated printing paper, and roller coating can be preferably used as a coating method to the entire surface. The pre-treatment liquid may be an aqueous liquid.

Corona or plasma treatment may be used as a pre-treatment step by exposing a sheet of a print medium to corona discharge or plasma treatment. In particular, when used on media such as polyethylene (PE) films, polypropylene (PP) films, polyethylene terephthalate (PET) films and machine coated media, the adhesion and spreading of the ink can be improved by increasing the surface energy of the medium. With machine-coated media, the absorption of water can be promoted which may induce faster fixation of the image and less puddling on the print medium. Surface properties of the print medium may be tuned by using different gases or gas mixtures as the medium in the corona or plasma treatment. Examples of such gases include: air, oxygen, nitrogen, carbon dioxide, methane, fluorine gas, argon, neon, and mixtures thereof. Corona treatment in air is most preferred.

Image Formation

When employing an inkjet printer loaded with inkjet inks, the image formation is typically performed in a manner whereby ink droplets are ejected from inkjet heads onto a print medium based on digital signals. Although both single-pass inkjet printing and multi-pass (i.e. scanning) inkjet printing may be used for image formation, single-pass inkjet printing is preferable as it is effective to perform high-speed printing. Single-pass inkjet printing is an inkjet printing method with which ink droplets are deposited onto the print medium to form all pixels of the image in a single passage of the print medium through the image forming device, i.e. beneath an inkjet marking module.

Referring to FIG. 1, after pre-treatment, the sheet S of print medium is conveyed on the transport belt 3 to an image forming device or inkjet marking module 9, where image formation is carried out by ejecting ink from inkjet marking devices 91, 92, 93, 94 arranged so that an entire width of the sheet S is covered. That is, the image forming device 9 comprises an inkjet marking module having four inkjet marking devices 91, 92, 93, 94, each being configured and arranged to eject an ink of a different color (e.g. Cyan, Magenta, Yellow and Black). Such an inkjet marking device 91, 92, 93, 94 for use in single-pass inkjet printing typically has a length corresponding to at least a width of a desired printing range R (i.e. indicated by the double-headed arrow on sheet S), with the printing range R being perpendicular to the media transport direction along the transport path P.

Figure 2:
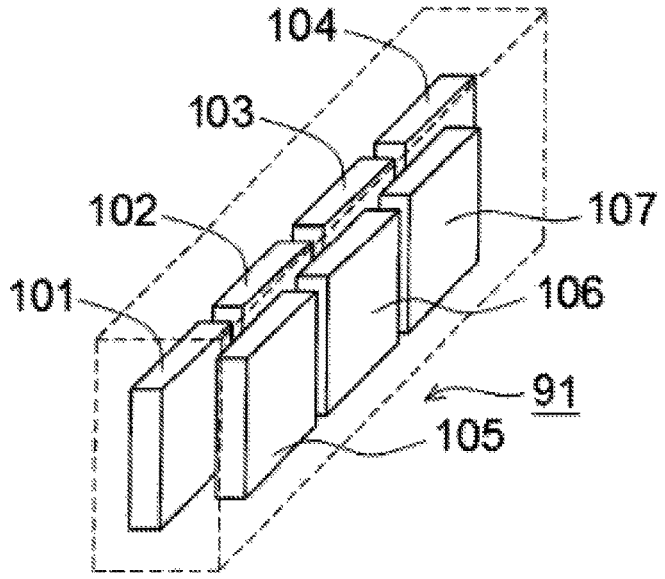
FIG. 2 is a schematic perspective view of an image forming device in the printing system of FIG. 1.
Figure 3A:
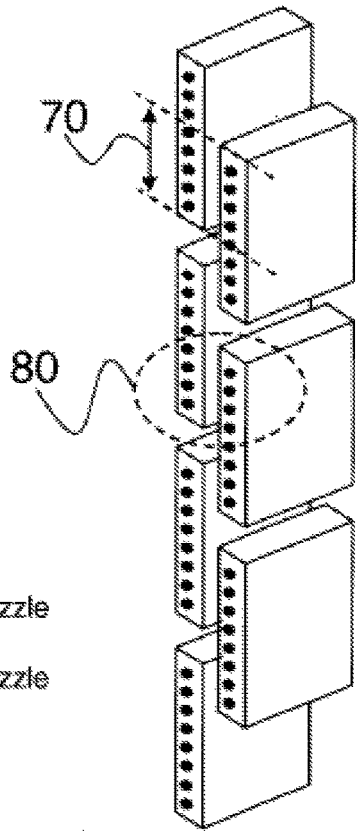
FIG. 3A is a schematic perspective underside view of printing heads in the image forming device of FIG. 2.
Figure 3B:
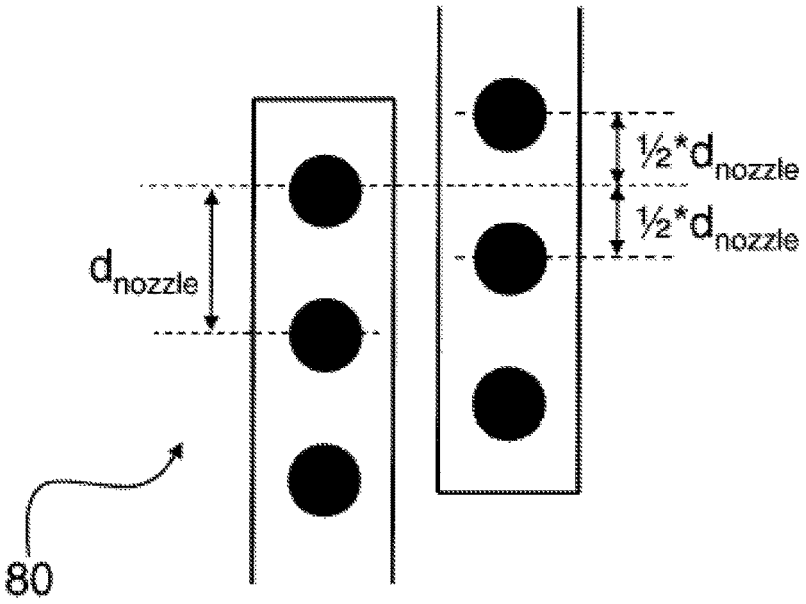
FIG. 3B is a detailed view of the printing heads in the image forming device of FIG. 2 and FIG. 3A.

Each inkjet marking device 91, 92, 93, 94 may have a single print head having a length corresponding to the desired printing range R. Alternatively, as shown in FIG. 2, the inkjet marking device 91 may be constructed by combining two or more inkjet heads or printing heads 101-107, such that a combined length of individual inkjet heads covers the entire width of the printing range R. Such a construction of the inkjet marking device 91 is termed a page wide array (PWA) of print heads. As shown in FIG. 2, the inkjet marking device 91 (the other inkjet marking devices 92, 93, 94 may be identical) comprises seven individual inkjet heads 101-107 arranged in two parallel rows, with a first row having four inkjet heads 101-104 and a second row having three inkjet heads 105-107 arranged in a staggered configuration with respect to the inkjet heads 101-104 of the first row. The staggered arrangement provides a page-wide array of inkjet nozzles 90, which nozzles are substantially equidistant in the length direction of the inkjet marking device 91. The staggered configuration may also provide a redundancy of nozzles in an area O where the inkjet heads of the first row and the second row overlap. (See in FIG. 3A). The staggering of the nozzles 90 may further be used to decrease an effective nozzle pitch d (and hence to increase print resolution) in the length direction of the inkjet marking device 91. In particular, the inkjet heads are arranged such that positions of the nozzles 90 of the inkjet heads 105-107 in the second row are shifted in the length direction of the inkjet marking device 91 by half the nozzle pitch d, the nozzle pitch d being the distance between adjacent nozzles 90 in an inkjet head 101-107. (See FIG. 3B, which shows a detailed view of 80 in FIG. 3A). The nozzle pitch d of each head is, for example, about 360 dpi, where "dpi" indicates a number of dots per 2.54 cm (i.e. dots per inch). The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed. Among them, it is preferable to use a piezo type inkjet recording head which has nozzles of a diameter of 30 μm or less in the current image forming method.

The image formation via the inkjet marking module 9 may optionally be carried out while the sheet S of print medium is temperature controlled. For this purpose, a temperature control device 10 may be arranged to control the temperature of the surface of the transport mechanism 2 (e.g. belt or drum 3) below the inkjet marking module 9. The temperature control device 10 may be used to control the surface temperature of the sheet S within a predetermined range, for example in the range of 30° C. to 60° C. The temperature control device 10 may comprise one or more heaters, e.g. radiation heaters, and/or a cooling device, for example a cold blast, in order to control and maintain the surface temperature of the print medium within the desired range. During and/or after printing, the print medium is conveyed or transported downstream through the inkjet marking module 9.

Drying and Fixing

After an image has been formed on the print medium, the printed ink must be dried and the image must be fixed on the print medium. Drying comprises evaporation of solvents, and particularly those solvents that have poor absorption characteristics with respect to the selected print medium.

FIG. 1 of the drawings schematically shows a drying and fixing unit 11, which may comprise one or more heater, for example a radiation heater. After an image has been formed on the print medium sheet S, the sheet S is conveyed to and passed through the drying and fixing unit 11. The ink on the sheet S is heated such that any solvent present in the printed image (e.g. to a large extent water) evaporates. The speed of evaporation, and hence the speed of drying, may be enhanced by increasing the air refresh rate in the drying and fixing unit 11. Simultaneously, film formation of the ink occurs, because the prints are heated to a temperature above the minimum film formation temperature (MFT). The residence time of the sheet S in the drying and fixing unit 11 and the temperature at which the drying and fixing unit 11 operates are optimized, such that when the sheet S leaves the drying and fixing unit 11 a dry and robust image has been obtained.

As described above, the transport mechanism 2 in the fixing and drying unit 11 may be separate from the transport mechanism 2 of the pre-treatment and printing parts or sections of the printing system 1 and may comprise a belt and/or a drum. Preferably, the transport mechanism 2 in the fixing and drying unit 11 comprises a drum and includes a device, such as one or more fans, especially a centrifugal fan, for generating an under-pressure or suction for holding a plurality of sheets of print medium in contact with an outer periphery of the drum 3. Further details of this embodiment of the transport mechanism 2 in the fixing and drying unit 11 will be described later.

Post Treatment

To improve or enhance the robustness of a printed image or other properties, such as gloss level, the sheet S may be post treated, which is an optional step in the printing process. For example, in a preferred embodiment, the printed sheets S may be post-treated by laminating the printed image. That is, the post-treatment may include a step of applying (e.g. by jetting) a post-treatment liquid onto a surface of the coating layer, onto which the ink has been applied, so as to form a transparent protective layer over the printed recording medium. In the post-treatment step, the post-treatment liquid may be applied over the entire surface of an image on the printed medium or it may be applied only to specific portions of the surface of an image. The method of applying the post-treatment liquid is not particularly limited, and may be selected from various methods depending on the type of the post-treatment liquid. However, the same method as used in coating the pre-treatment liquid or an inkjet printing method is preferable. Of these, an inkjet printing method is particularly preferable in view of: (i) avoiding contact between the printed image and the post-treatment liquid applicator; (ii) the construction of an inkjet recording apparatus used; and (iii) the storage stability of the post-treatment liquid. In the post-treatment step, a post-treatment liquid containing a transparent resin may be applied on the surface of a formed image so that a dry adhesion amount of the post-treatment liquid is 0.5 g/m2 to 10 g/m2, preferably 2 g/m2 to 8 g/m2, thereby forming a protective layer on the recording medium. If the dry adhesion amount is less than 0.5 g/m2, little or no improvement in image quality (image density, color saturation, glossiness and fixability) may be obtained. If the dry adhesion amount is greater than 10 g/m2, on the other hand, this can be disadvantageous from the view-point of cost efficiency, because the dryness of the protective layer degrades and the effect of improving the image quality is saturated.

As a post-treatment liquid, an aqueous solution comprising components capable of forming a transparent protective layer over the print medium sheet S (e.g. a water-dispersible resin, a surfactant, water, and other additives as required) is preferably used. The water-dispersible resin in the post-treatment liquid preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin is preferably radiation curable to improve the glossiness and fixability of the image. As the water-dispersible resin, for example, any one or more of an acrylic resin, a styrene-acrylic resin, a urethane resin, an acryl-silicone resin, a fluorine resin or the like, is preferably employed. The water-dispersible resin can be suitably selected from the same materials as that used for the inkjet ink. The amount of the water-dispersible resin contained, as a solid content, in the protective layer is preferably 1% by mass to 50% by mass. The surfactant used in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus, as shown in FIG. 1. However, the printing system 1 and the associated printing process are not restricted to the above-mentioned embodiment. A system and method are also contemplated in which two or more separate machines are interconnected through a transport mechanism 2, such as a belt conveyor 3, drum conveyor or a roller, and the step of applying a pre-treatment liquid, the (optional) step of drying a coating solution, the step of ejecting an inkjet ink to form an image and the step or drying and fixing the printed image are performed separately. Nevertheless, it is still preferable to carry out the image formation with the above defined in-line image forming method and printing system 1.

Figure 4:
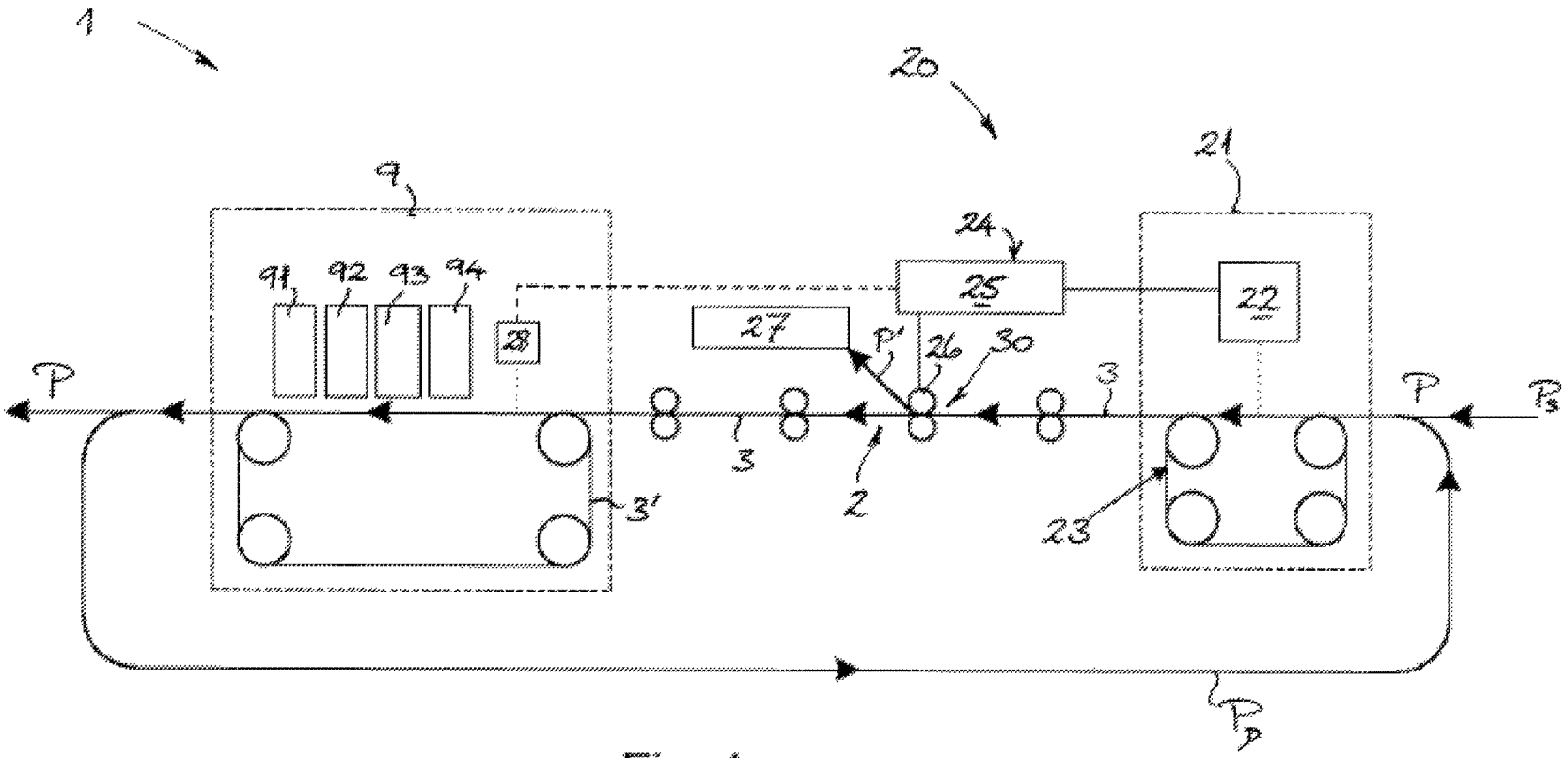
FIG. 4 is a schematic side view of a printing system with a defect detection system according to an embodiment of the present invention.

With reference now to FIG. 4 of the drawings, the inkjet printing system 1 according to a preferred embodiment of the present invention is shown to include an apparatus 20 for detecting defects in the printing system 1, and particularly for identifying and for classifying deformations D in the sheets S of print medium when the sheets S are on the transport path P of the printing system 1. In this particular embodiment, the apparatus 20 comprises a sensing unit 21, which processes the sheets S on the transport path P before those sheets S enter the image forming device 9. In this regard, it will be noted that the printing system 1 in FIG. 4 has a transport path P which includes both a simplex path PS and a duplex path PD. The sensing unit 21 of the apparatus 20 is arranged such that sheets S input on the simplex path PS and also returning on the duplex path PD all pass via the sensing unit 21.

At least one first sensor device 22 in the form of an optical sensor, such as a laser scanner, is provided within the sensing unit 21 for sensing the surface geometry or topology of the sheets S as they travel on a first pass or a second pass along the transport path P. The laser scanner or optical sensor device 22 generates digital image data I of the three-dimensional surface geometry or topology of each sheet S sensed or scanned. When performing the sensing or measuring of the surface geometry or topology of the sheets S on the transport path P of printing system 1 with the first sensor device(s) 22, it is highly desirable for the purposes of accuracy and reliability that the sheets S are transported or conveyed in the sensing unit 21 in substantially the same manner as those sheets S are later transported in the image forming unit or marking module 9. To this end, the sensing unit 21 includes a sheet conveyor mechanism 23 that simulates the sheet transport conditions provided by the transport mechanism 3' within the image forming unit 9. In this regard, both the conveyor mechanism 23 and the transport mechanism 3' include a belt transport device with vacuum sheet-holding pressure, as seen in FIG. 4.

The sheet topology data from the first sensor device 22 is then transmitted (e.g. either via a cable connection or wirelessly) to a controller 24, which includes a processor device 25 for processing and analyzing the digital image data I to detect and to classify any defect or deformation D in the surface geometry or topology of each sheet S sensed or scanned. The sensing unit 21 is thus arranged to scan the sheets S for detecting and measuring any deformations or defects D before the sheets S enter the image forming device or inkjet marking module 9. In this way, if the processor device 25 determines that a sheet S on the transport path P includes a defect or deformation D that would render the sheet unsuitable for printing, the controller 24 is configured to prevent the sheet S from progressing to the inkjet marking module 9. The sensing unit 21 comprising the first sensor device(s) 22 is therefore desirably provided as a separate sentry unit positioned on the transport path P sufficiently upstream of the marking module 9. The controller 24 and processor device 25 may be integrated within the sensing unit 21 or they may be separately or remotely located.

Printing System Control

After the image data I has been analyzed by the processor 25 and the defects or deformations D within the sheet S have been extract and classified accordingly, the controller 24 may transmit a control signal (e.g. either via a cable connection or wirelessly) to a removal device or ejector device 26 for regulating the transport or conveyance of the sheets S to the image forming device or inkjet marking module 9. In particular, if the sheet S has been determined by the processor 25 to include one or more deformations D with a size or extent above a predetermined threshold sufficient to render the sheet unsuitable for printing, the controller 24 is configured to control or operate the removal device 26 to remove or eject the sheet S from the transport path P to an alternative path P' towards a reject tray 27. The controller 24 controls the sheet removal or rejection via the removal device 26 on the basis of a sheet form detection result from the processor device 25 compared with at least one predetermined rejection criterion. This rejection criterion is typically defined by a maximum allowable height H of a detected deformation D out of the plane of the sheet S, because in an inkjet printing system 1 the passage of the sheet S through the narrow print gap under the printing heads 101-107 is most critical. In particular, while a larger print gap in inkjet applications provides robustness against sheet deformations or sheet jams, it results in a lower print quality, so the print gap is kept as small as practicable. Thus, sheet jams within the print module or image forming device 9 may be avoided when sheets S are found to contain too much deformation. At least one second sensor 28 for sensing the surface geometry or topology of the sheet S located within the image forming unit 9 can be used to provide feedback or correlation data to the sensing unit 21 or to the controller 24 to increase the accuracy of the measurement of the sheet deformation D.

Removal Device

Figure 5:
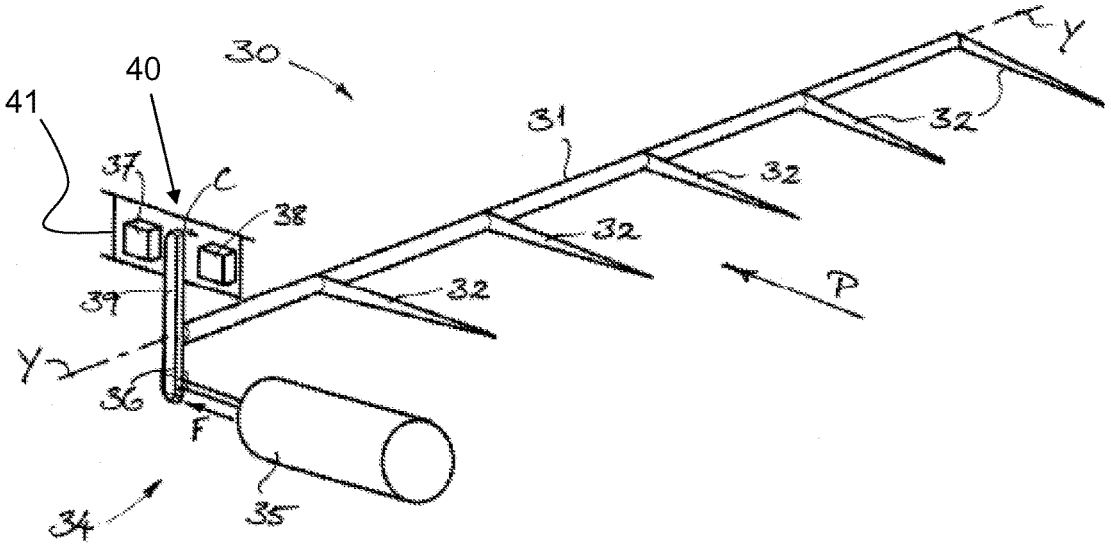
FIG. 5 is a schematic perspective view of a device for redirecting sheets in a printing system according to an embodiment of the present invention.
Figure 6:
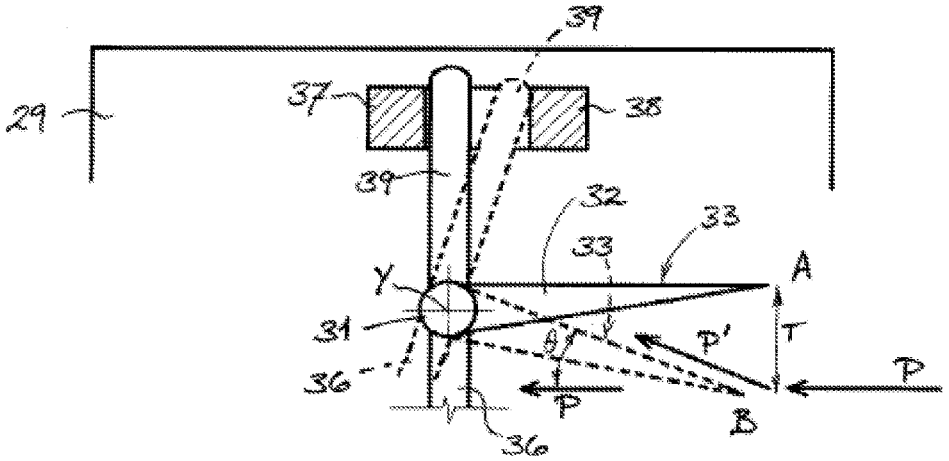
FIG. 6 is a side view of part of the device for redirecting sheets from FIG. 5, showing the support member and guide member(s) of the device in both a first, inoperative position and a second, operative position.
Figure 7:
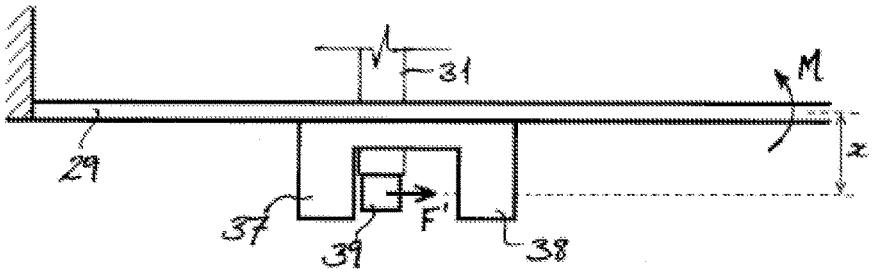
FIG. 7 is a top or plan view of part of the device for redirecting sheets shown in FIG. 5.

With reference now to FIGS. 5 to 7 of the drawings, a device 30 for redirecting one or more defective sheets S being conveyed by the transport mechanism 2 from the transport path P to the alternative path P' towards the reject tray 27 is provided. The sheet redirection device 30 thus forms a part of the removal device 26 located between the sensing unit 21 and the inkjet marking module 9.

As can be seen in FIG. 5, the sheet redirection device 30 comprises an elongate support member 31 provided in the form of a shaft. This shaft member 31 supports a plurality of guide members 32, which are rigidly connected thereto for directing a path of travel of the sheet S. In this regard, each guide member 32 is elongate and comprises a prong- or needle-like element having a tapered form and presenting a guide surface 33 over an upper side thereof for directing the path of travel of the sheets S. The support shaft 31 is mounted adjacent or next to the transport path P of the sheets S in the transport mechanism 2, with the shaft extending transversely across, substantially at a right angle to the direction of travel of the sheets S along that transport path P. Furthermore, as can be seen in FIG. 6, the support shaft 31 is mounted for rotation about a central axis Y between a first inoperative position A in which the guide members 32 extend generally parallel to the transport path P and do not impinge on the transport path P, and a second operative position B in which the guide members 32, and especially respective tip regions or distal end regions thereof, are inserted or placed into the transport path P for redirecting one or more of the sheets S via the guide surfaces 33 to a second, alternative transport path P', which then conveys the sheets to the reject tray 27. In the second position B, the guide members 32 extend inclined at an acute angle θ in the range of 20° to 40° to the regular transport path P of the sheet S.

Figure 8:
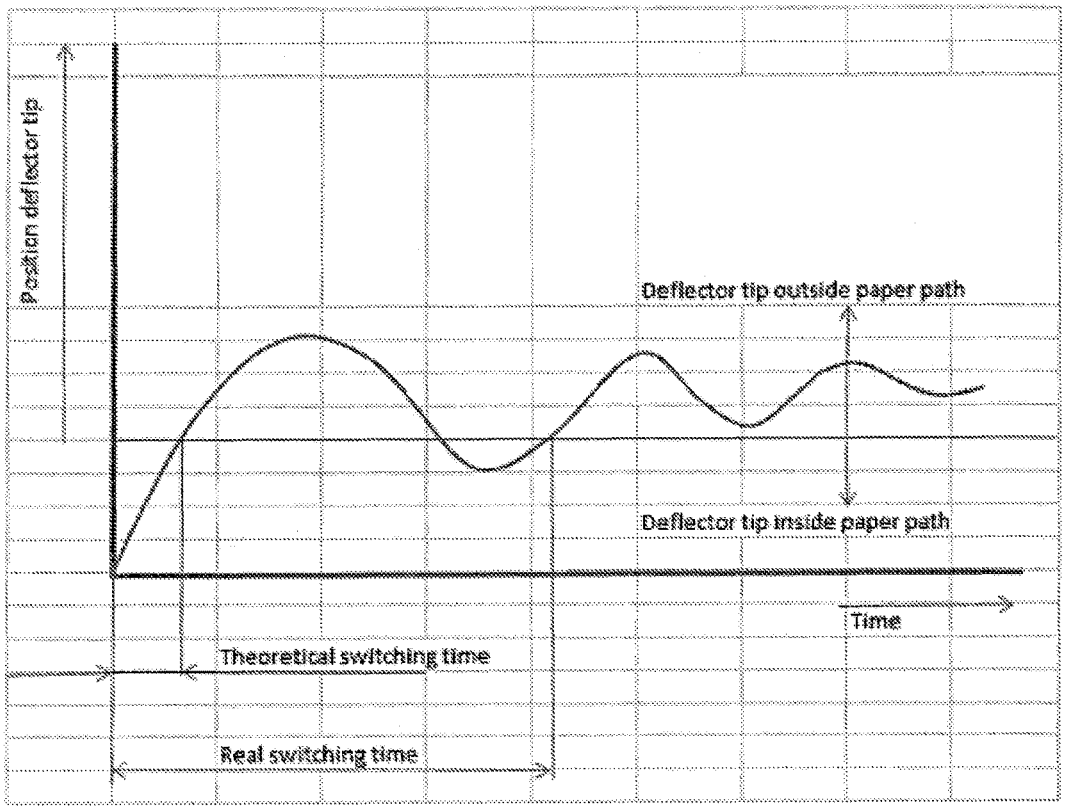
FIG. 8 is a graph illustrating vibration of a redirecting element or deflector element of a conventional device for redirecting sheets in a transport mechanism of a printing system.

The plurality of sheets S to be printed are conveyed by the transport mechanism 2 in the printing system 1 at a relatively high sheet feed-rate of about 300 sheets per minute, with the sheets S arranged in series along the transport path P. The sheet cycle time for each sheet S is a sum of (i) the time required to convey or transport the sheet itself past a given point, and (ii) the time required for passage of a space or gap between that sheet and the next sheet following in the series. When the feed rate of the sheets S is at 300 sheets per minute, the sheet cycle time is 200 milliseconds per sheet, such that the time available for the space or gap between the sheets is only in the range of about 10 to 50 milliseconds, e.g. about 20 to 40 milliseconds. Nevertheless, this represents the amount of time and the physical space or gap within which the device 30 for redirecting a defective sheet S is required to operate. In other words, the support shaft 31 of the device 30 must be switched or rotated from the first position A to the second position B to move the prong-like guide members 32 into the space or gap upstream of the defective sheet S on the regular transport path P to redirect the defective sheet S via guide surfaces 33. The high switching speed required by the device 30 demands that the dynamics, vibration, and/or bouncing of the support shaft 31 and guide members 32 are under control. As the inventors have ascertained for conventional sheet redirection devices, inadequate vibration control and bouncing can be the cause of sheet deflector tips inadvertently re-entering the sheet path as depicted in FIG. 8. In FIG. 8, the graph shows the vibration of a sheet deflector (generally analogous to the guide member 32 in the device 30 of the present embodiment) and illustrates that, although the deflector has ostensibly been moved out of the paper sheet path, the tip of the sheet deflector nevertheless oscillates back into the paper sheet path where it may interfere with other sheets on the transport path and potentially cause a sheet jam. The sheet redirection device 30 of the present embodiment has been developed in view of this phenomenon. In this regard, the inventors have ascertained that the behavior shown in FIG. 8 occurs when the system resonance time is high compared to the theoretical switching time.

Referring again to FIGS. 5 to 7 of the drawings, the device 30 for redirecting one or more of the sheets S further comprises an actuator 34 configured to move or rotate the support shaft 31 between the first and second positions A, B. In this regard, the actuator 34 include a linear actuator 35, such as a solenoid actuator, connected to the support shaft 31 via a lever arm 36 for generating a drive action or actuating force F, which acts in a direction substantially parallel to the transport path P. In other words, the actuator 34 includes the lever arm 36, which is rigidly and directly connected to an end of the support shaft 31 and interconnects the linear actuator 35 with the support shaft 31 for transmitting a drive force or an actuating force from the solenoid to rotate the support shaft 31 between the first and second positions A, B. Thus, the input force from the linear actuator 35 to the support shaft 31 acts substantially parallel to the regular transport path P and the lever arm 36 extends approximately perpendicular to the transport path P. That is, the linear actuator 35 is connected to the support shaft 31 such that vibrations imparted by the linear actuator 35 to the shaft 31 as it rotates between the first and the second positions A, B are directed substantially parallel to the regular transport path P. The solenoid actuator 35 may be double-acting, i.e. in both directions, or it may be single-acting from the first position A to the second position B and operate in conjunction with a spring, e.g. a return spring, to return the shaft 31 and the guide members 32 to the first position A when the solenoid is de-energized or switched off.

The support shaft 31 has a relatively small diameter in order to provide space for the sheets S to pass below the shaft 31 when the sheets travel along the regular transport path P. In this regard, a distance T traversed by a tip or distal end region of the guide members 32 when the shaft rotates from the first position A to the second position B shown in FIG. 7 is typically in the range of 5 mm to 10 mm (e.g. about 8 mm). The small diameter of the support shaft 31 results in a relatively low bending stiffness and thus a low resonance frequency for the shaft 31. The tip stroke or tip distance T of the guide members 32 is defined or set using stop members 37, 38 provided in the form of adjustable end blocks which cooperate with an elongate contact member 39 rigidly connected to the end of the shaft 31. The adjustable end blocks 37, 38 therefore respectively define the first, inoperative position A and the second, operative position B of the support shaft 31 in the sheet redirection device 30 and the contact member 39 makes contact with the respective end block 37, 38 in both positions. The first and second positions A, B are therefore not determined by the actuator 35 employed. Rather, the actuator 35 merely supplies force F or torque in the desired direction.

The fast switching of the support shaft 31 between the first and second positions A, B implies or dictates that the end positions A, B are reached with an impact at the stop members 37, 38, while guide members 32 and elongate contact member 39 have a high velocity. Because the linear actuator 35 and the stop members 37, 38 are positioned in planes substantially parallel to the shaft 31 and to the regular transport path P, the impact force also acts in a plane substantially parallel to the guide members 32. In this regard, the bending stiffness of the contact member 39 is selected to be high compared to the bending stiffness of the shaft 31. Because of this, the shaft 31 will vibrate or resonate in a plane substantially parallel to the regular sheet transport path P, preventing vibration in the shaft 31 from causing the tips of the guide members 32 to re-enter the transport path after the shaft 31 is moved to the first position A (as shown in FIG. 8). An impact force F' of the contact member 39 also acts on the end blocks 37, 38 mounted on a frame 29 of the printing system 1 such that the impact force F' causes a bending moment M in the frame 29. The bending stiffness of the contact member 39 is selected to be high compared to a bending stiffness of this frame 29, to avoid bouncing and to cause the frame 29 to absorb energy. To this end, the frame 29 may include a cut-out region C around the stop members 37, 38. The cut-out region C defines a resilient suspension 40, which connects the stop members 37, 38 to the frame 29. The stop members 37, 38 are positioned on a spring element 41, which allows the stop members 37, 38 to vibrate in a plane substantially parallel to the transport path P. Alternatively, the suspension 40 could allow the stop members 37, 38 to vibrate in a direction parallel to the transport path P. Further, the frame 29 may be configured to vibrate in a plane substantially parallel to the transport path P, thereby also preventing the tips of the prong-like guide members 32 from re-entering the transport path P after the shaft 31 is moved to the first position A.

Figure 9B:
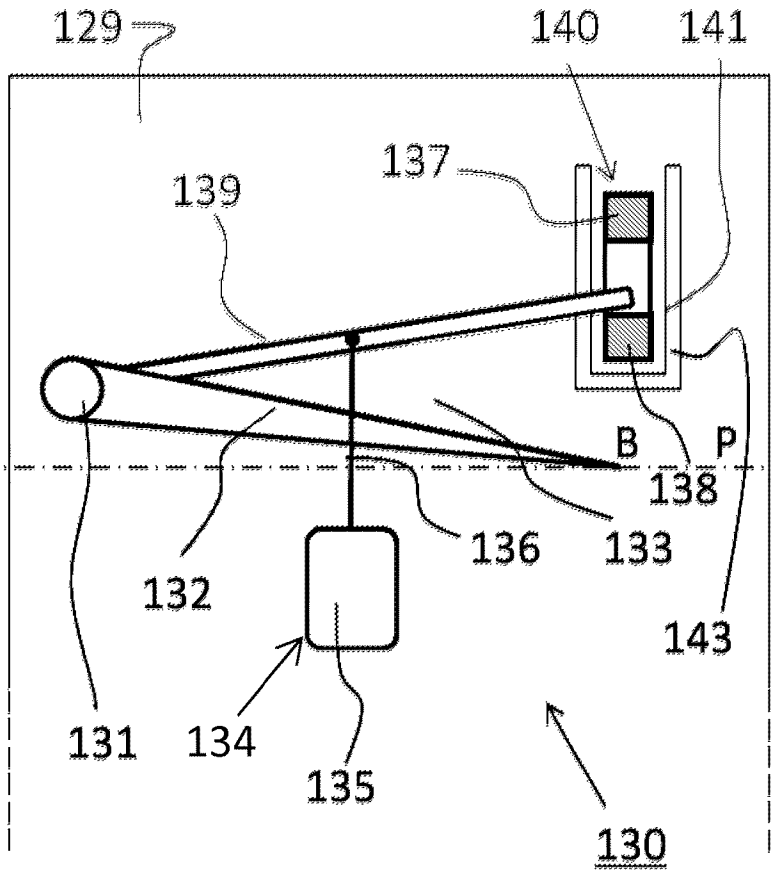
FIGS. 9*a* and 9*b* are side views of part of a second embodiment of a device for redirecting sheets according to the present invention, showing the support member and guide member(s) of the device in both a first, inoperative position (FIG. 9*a*) and a second, operative position (FIG. 9*b*).
Figure 9A:
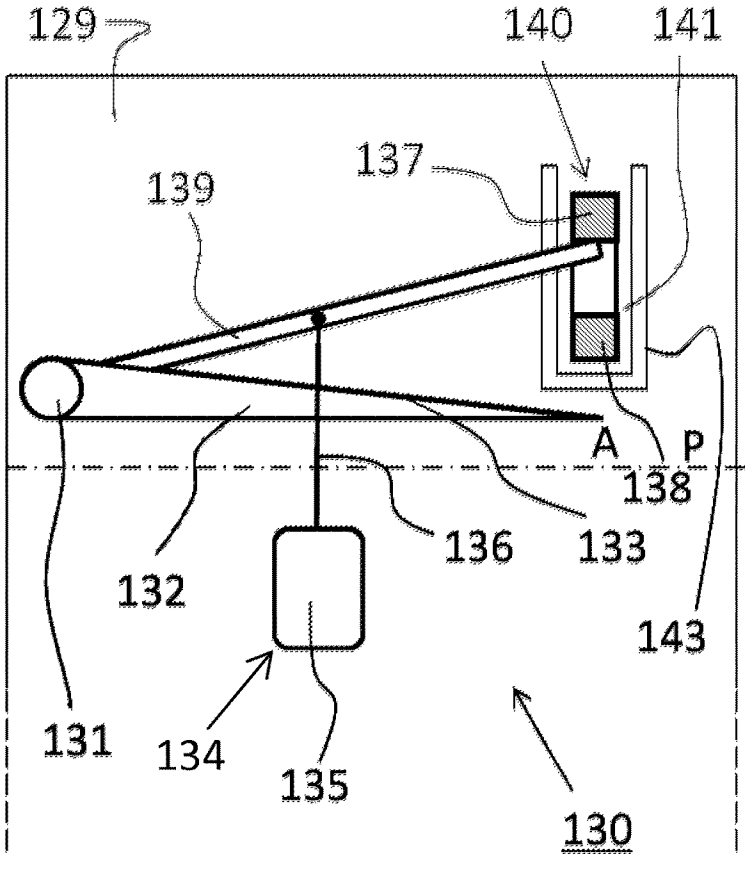

FIG. 9 is a side view of part of a second embodiment of a device 130 for redirecting sheets according to the present invention, showing the support member 131 and guide member(s) 132 of the device 130 in both a first, inoperative position A (FIG. 9*a*) and a second, operative position B (FIG. 9*b*). The operation of the embodiment in FIGS. 9*a*-*b* is similar to that of the embodiments in FIG. 5-6. Hence, only the differences between these embodiments will be discussed here in detail.

Referring to FIGS. 9*a*-*b* of the drawings, the device 130 for redirecting one or more of the sheets S further comprises an actuator 134 configured to move or rotate the support shaft 131 between the first position A in FIG. 9*a* and the second position B in FIG. 9*b*. In this regard, the actuator 134 includes a linear actuator 135, such as a solenoid actuator, connected to the support shaft 131 via a lever arm 136 for generating a drive action or actuating force F, which acts in a direction perpendicular or at a small angle (1 to 20 degrees) to the to the transport path P (indicated by the horizontal dashed line). In other words, the actuator 134 includes the lever arm 136, which is rigidly and directly connected to an end of the support shaft 131 and interconnects the linear actuator 135 with the support shaft 131 for transmitting a drive force or an actuating force from the linear actuator 135 to rotate the support shaft 131 between the first and second positions A, B. Thus, the input force from the linear actuator 135 to the support shaft 131 acts substantially perpendicular to the regular transport path P and the lever arm 136 extends at a relatively small angle to the direction of to the transport path P.

The support shaft 131 has a relatively small diameter in order to provide space for the sheets S to pass below the shaft 131 when the sheets travel along the regular transport path P. The tip stroke or tip distance T of the guide members 132 is defined or set using stop members 137, 138 provided in the form of adjustable end blocks, which cooperate with an elongate contact member 139 rigidly connected to the end of the shaft 131. The adjustable end blocks 137, 138 therefore respectively define the first, inoperative position A and the second, operative position B of the support shaft 131 in the sheet redirection device 30 and the contact member 139 makes contact with the respective end block 137, 138 in both positions. The first and second positions A, B are therefore not determined by the actuator 135 employed. Rather, the actuator 135 merely supplies the force F or torque in the desired direction.

While in FIGS. 5-6, the contact member 139 extends from the support member 131 in an opposite direction to the lever arm 136, the contact member 139 and the lever arm 136 in FIG. 9*a-b* extend in the same direction. In FIGS. 9*a-b*, the contact member 139 and the lever arm 136 form a single actuation arm 136, 139 extending from the support member 131. The actuator 135 engages the actuation arm 136, 139 at substantially half the length of the actuation arm 136, 139, whereas the stop members 137, 138 come into contact with the free end of the actuation arm 136, 139.

The fast switching of the support shaft 131 between the first and second positions A, B implies or dictates that the end positions A, B are reached with an impact at the stop members 137, 138 while guide members 132 and elongate contact member 139 have a high velocity. An impact force F' of the contact member 139 also acts on the end blocks 137, 138 mounted on a frame 129 of the printing system, such that the impact force F' causes a bending moment M in the frame 129. The bending stiffness of the contact member 139 is selected to be high compared to a bending stiffness of this frame 129, to avoid bouncing and to cause the frame 129 to absorb energy. To this end, the frame 129 may include a cut-out region C around the stop members 137, 138, such that a spring element 141 is formed. Due to the cut-out region C, the stop members 137, 138 are mounted to the frame 129 via a resilient suspension 140. The suspension 140 is arranged for absorbing (vibrational) energy from the impact between the contact member 139 and the stop members 137, 138. Further, the frame 129 may be configured to vibrate in a plane substantially parallel to the transport path P, thereby also preventing tips of the prong-like guide members 132 from re-entering the transport path P after the shaft 131 is moved to the first position A. Preferably, the cut-out region C allows the stop members 137, 138 to vibrate in a plane parallel to the transport path P.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A device for redirecting sheets in a sheet transport mechanism, the device comprising:

a support member having at least one guide member for directing a path of travel of a sheet, the support member being configured to be mounted adjacent a first transport path of a plurality of sheets such that the support member is movable between a first inoperative position in which the at least one guide member does not impinge on the first transport path, and a second operative position in which the at least one guide member is introduced into the first transport path to redirect one or more of said sheets to a second, alternative transport path; and an actuator configured to move the support member between the first and second positions, wherein a first stop member defines the first position, a second stop member defines the second position, and a contact member engages the first stop member when the support member moves to the first position from the second position, and the contact member engages the second stop member when the support member moves to the second position from the first position, wherein the first stop member and the second stop member are mounted on a frame by a resilient suspension, and wherein the bending stiffness of the contact member is selected to be high compared to a bending stiffness of the resilient suspension and/or the frame, such that the resilient suspension and/or the frame is able to absorb vibrational energy and/or bouncing of the contact member is reduced.

2. The device according to claim 1, wherein the support member is configured for rotation between the first position and the second position, and wherein the actuator includes a linear actuator connected to the support member for generating a drive action in a direction substantially parallel to the first transport path.

3. The device according to claim 2, wherein the linear actuator comprises one or more solenoids or a linear motor.

4. The device according to claim 1, wherein the support member is elongate, and mounted for rotation about a longitudinal axis thereof, the support member being configured to extend transversely of or across the first transport path, and wherein each of the at least one guide member extends from the support member transverse to the longitudinal axis of the support member.

5. The device according to claim 1, wherein the actuator includes a lever arm connected to the support member and configured to transmit force to move the support member between the first and second positions, wherein the lever arm interconnects the linear actuator with the support member, and wherein the lever arm extends substantially perpendicular to the first transport path.

6. The device according to claim 1, wherein the actuator includes the first stop member defining the first position, and the contact member provided on the support member to engage the first stop member when the support member moves to the first position from the second position, and wherein the contact member extends substantially perpendicular to the first transport path when the support member is in the first position.

7. The device according to claim 6, wherein the actuator has the second stop member defining the second position, and the contact member provided on the support member engages the second stop member when the support member moves to the second position from the first position, and wherein a position of either or both of the first and second stop members is adjustable.

8. The device according to claim 1, wherein each of the at least one guide member extends substantially parallel to the first transport path of the sheets in the first position.

9. The device according to claim 1, wherein each of the at least one guide member extends inclined at an acute angle to the first transport path of the sheets in the second position.

10. The device according to claim 9, wherein the acute angle is in the range of 10° to 60°.

11. The device according to claim 9, wherein the acute angle is in the range of 20° to 40°.

12. The device according to claim 1, wherein a controller is configured to control operation of the actuator to move or switch the support member between the first and second positions, depending on a detected state of the sheets travelling along the first transport path.

13. The device according to claim 1, wherein the contact member is provided on the support member.

14. The device according to claim 1, wherein the resilient suspension comprises a spring element connecting the first and second stop members to the frame.

15. The device according to claim 1, wherein the frame comprises a cut-out region around the stop members for forming the resilient suspension.

16. The device according to claim 1, wherein the support member is configured for rotation between the first position and the second position and wherein the actuator includes a linear actuator connected to the support member for generating a drive action in a direction substantially parallel to the first transport path, wherein the actuator is connected to the support member such that vibrations imparted by the actuator to the support member as the support member moves between the first and the second positions are substantially parallel to the first transport path.

17. A transport mechanism for transporting sheets of a print medium in a printing system, comprising:

the device for redirecting sheets according to claim 1.

18. A device for redirecting sheets in a sheet transport mechanism, the device comprising:

a support member having at least one guide member for directing a path of travel of a sheet, the support member being configured to be mounted adjacent a first transport path of a plurality of sheets such that the support member is movable between a first inoperative position in which the at least one guide member does not impinge on the first transport path, and a second operative position in which the at least one guide member is introduced into the first transport path to redirect one or more of said sheets to a second, alternative transport path; and an actuator configured to move the support member between the first and second positions, wherein a first stop member defines the first position, a second stop member defines the second position, and a contact member engages the first stop member when the support member moves to the first position from the second position, and the contact member engages the second stop member when the support member moves to the second position from the first position, wherein the first stop member and the second stop member are mounted on a frame by a resilient suspension, and wherein the resilient suspension comprises a spring element connecting the first and second stop members to the frame.

* * * * *